US008421624B2

(12) United States Patent
Hsu

(10) Patent No.: US 8,421,624 B2
(45) Date of Patent: Apr. 16, 2013

(54) HOME SECURITY SYSTEM

(76) Inventor: Tau-Jeng Hsu, Taipei (TW)

( * ) Notice: Subject to any disclaimer, the term of this patent is extended or adjusted under 35 U.S.C. 154(b) by 154 days.

(21) Appl. No.: 13/103,116

(22) Filed: May 9, 2011

(65) Prior Publication Data

US 2012/0286947 A1 Nov. 15, 2012

(51) Int. Cl.
*G08B 13/00* (2006.01)

(52) U.S. Cl.
USPC ..... 340/541; 340/538; 340/565

(58) Field of Classification Search ..... 340/538, 340/541
See application file for complete search history.

(56) References Cited

U.S. PATENT DOCUMENTS

| | | | | |
|---|---|---|---|---|
| 6,204,760 | B1 * | 3/2001 | Brunius | 340/529 |
| 7,440,620 | B1 * | 10/2008 | Aartsen | 382/218 |
| 2009/0045952 | A1 * | 2/2009 | Bahari | 340/541 |

* cited by examiner

*Primary Examiner* — Kerri McNally

(57) ABSTRACT

A home security system includes a plurality of monitoring assemblies each comprising a data communication device, a light, a video camera, a transmitter, a sensor, a loudspeaker, a warning device, an identification device, a projector, an adjustment device for adjusting angles of the light, the video camera, and the projector, and a power supply; a fixed controller comprising a data communicating device and a data storage device; and a hand-held portable controller comprising a wireless communication module and an equipment set module. The fixed controller is adapted to activate the monitoring assemblies. The hand-held, portable controller is adapted to remotely activate the monitoring assemblies.

5 Claims, 3 Drawing Sheets

HOME SECURITY SYSTEM

BACKGROUND OF THE INVENTION

1. Field of the Invention

The invention relates to security systems and more particularly to a home security system with improved characteristics.

2. Description of Related Art

With respect to residences, it is known that a home's locks, lights, garage doors, etc. may be controlled using a PC or other computing system. A home also sometimes comprises a surveillance system. The surveillance system may have a number of cameras positioned at strategic positions inside and outside the house.

The cameras often feed into a recording device in the home. Additionally, the system may be set up so that the home owner may observe any activity of interest (e.g., a prowler) on one or more television monitors within the home. Sensors have also incorporated into home security systems. When these sensors are tripped, audible alarms will alert the home owner of the presence of an unwelcome intruder. A signal may also be sent to an emergency response agency automatically.

However, above home security system are undesirably inaccessible to the absent home member. A home owner may have to leave work early to let in a family member who is without a key. Also, the absent home owner will have no idea an alarm has been tripped in the house until notified by, for example, a police.

Thus, the need for improvement still exists.

SUMMARY OF THE INVENTION

It is therefore one object of the invention to provide a home security system comprising a plurality of monitoring assemblies each comprising a data communication device, a light, a video camera, a transmitter, a sensor, a loudspeaker, a warning device, an identification device, a projector, an adjustment device for adjusting angles of the light, the video camera, and the projector, and a power supply; a fixed controller comprising a data communicating device and a data storage device; and a hand-held portable controller comprising a wireless communication module and an equipment set module; the fixed controller is adapted to activate the monitoring assemblies; and wherein the hand-held, portable controller is adapted to remotely activate the monitoring assemblies.

The above and other objects, features and advantages of the invention will become apparent from the following detailed description taken with the accompanying drawings.

DETAILED DESCRIPTION OF THE INVENTION

Figure 1:
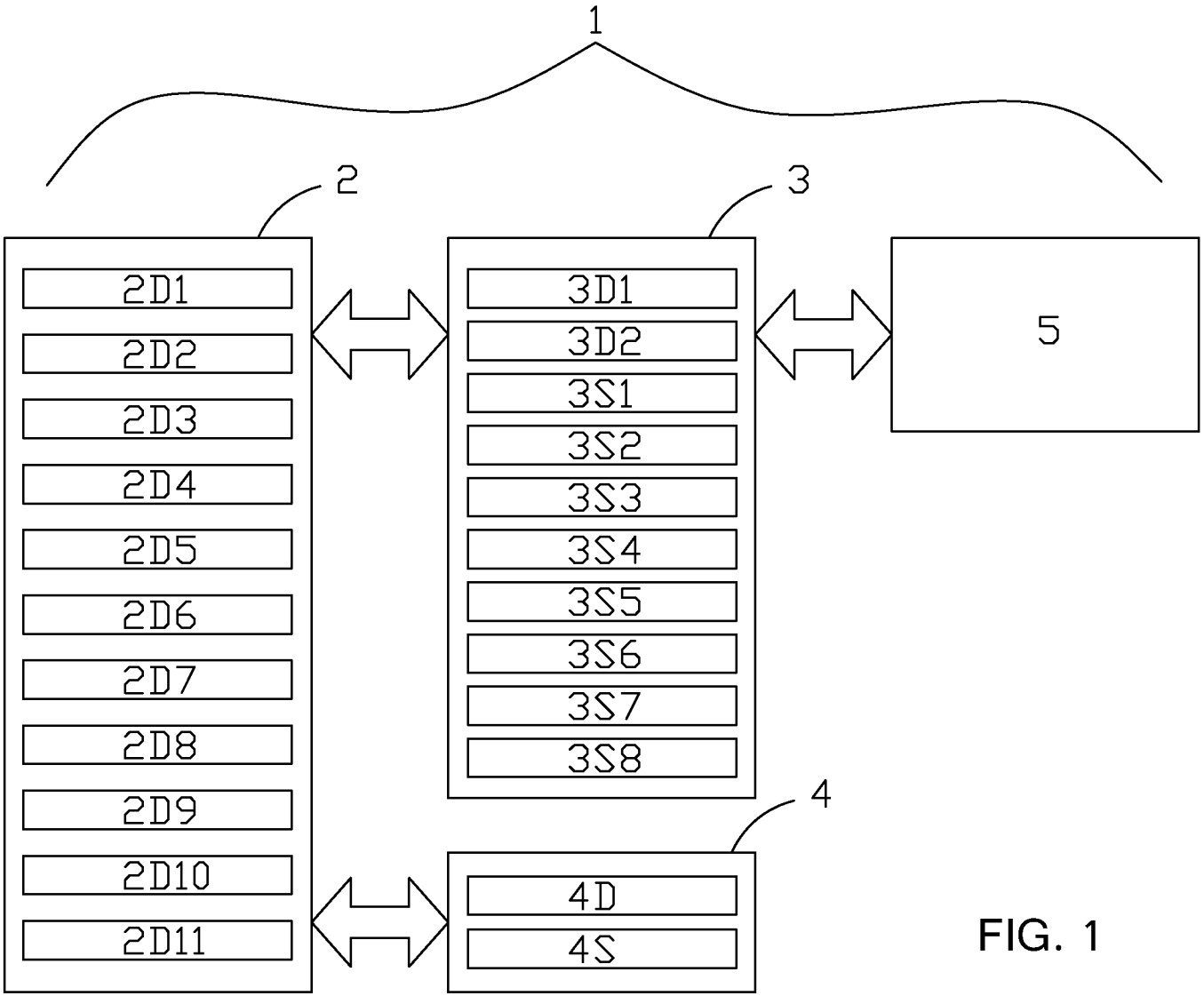
FIG. 1 is a block diagram of a home security system according to the invention.
Figure 4:
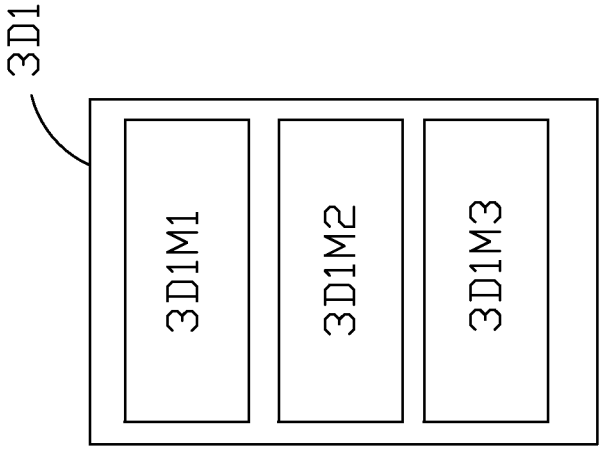
FIG. 4 is a block diagram of the data communication device.
Figure 3:
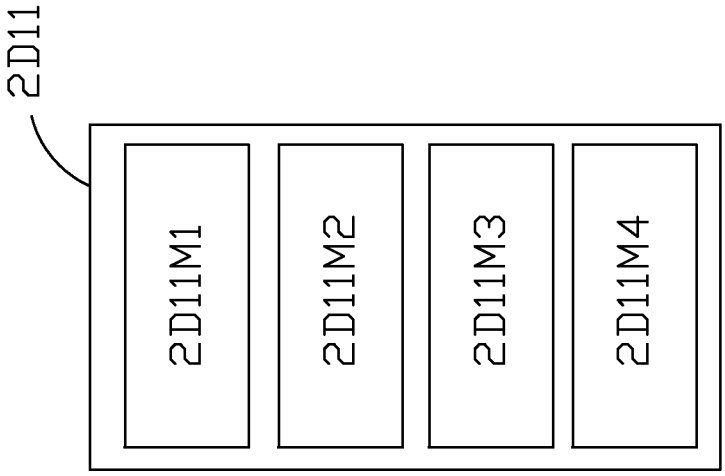
FIG. 3 is a block diagram of the power supply module.
Figure 2:
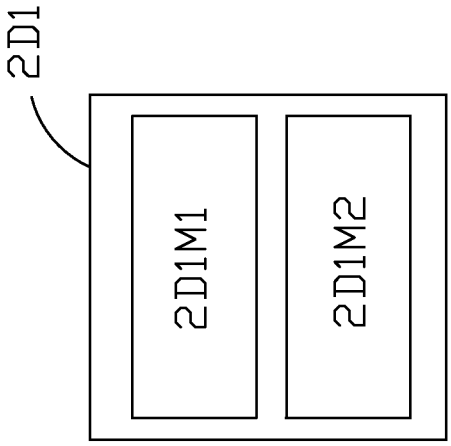
FIG. 2 is a block diagram of the data communication device.
Figure 5:
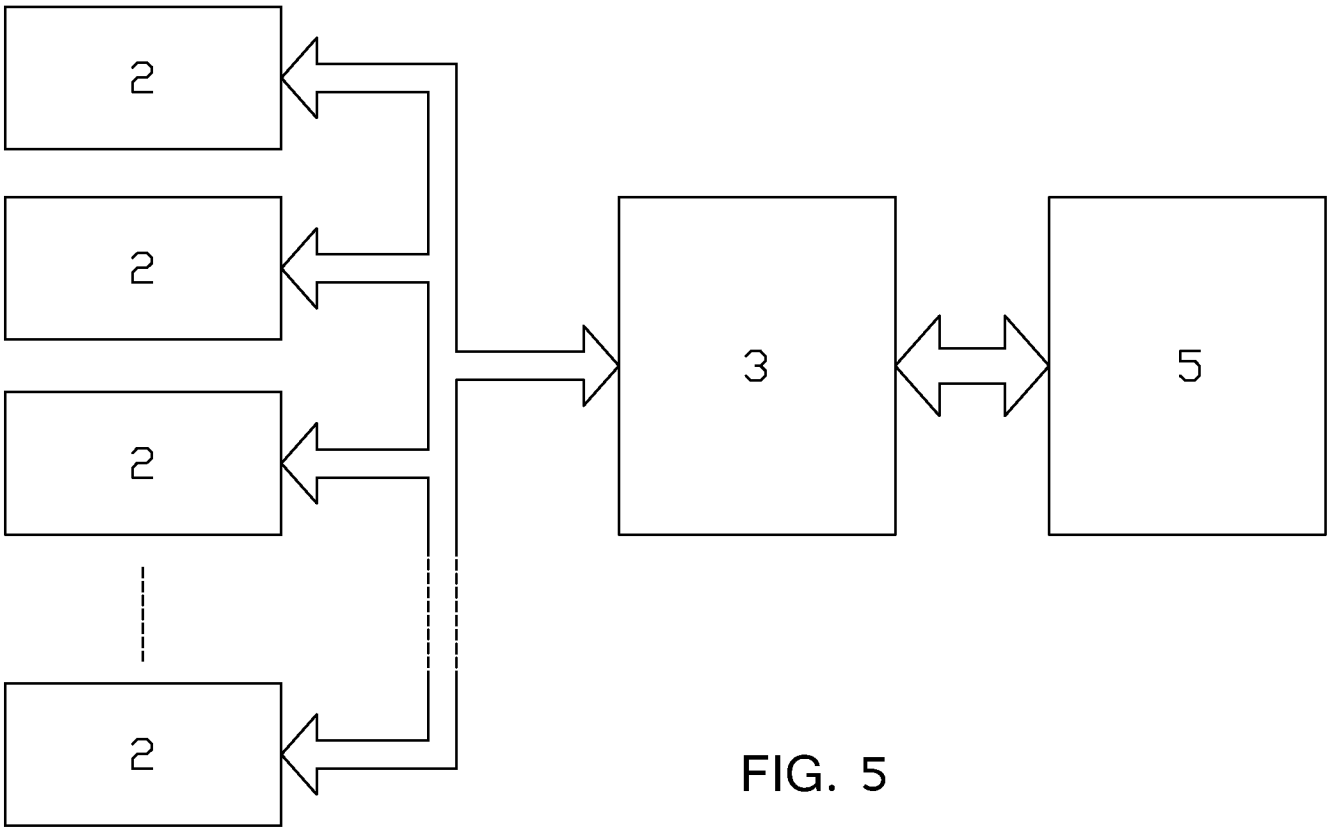
FIG. 5 is a block diagram of a home security system according to a preferred embodiment of the invention where the home security system is activated by a wireless device over the Internet.

Referring to FIGS. 1 to 5, a home security system 1 in accordance with the invention comprises a plurality of monitoring assemblies 2, a fixed controller 3, a hand-held portable controller 4, and a wireless device 5. Each component will be discussed in detail below.

Each of the monitoring assemblies 2 is positioned at a strategic position inside or outside a house and comprises a data communication device 2D1 for communicating data, a light 2D2 for illuminating a desired position, a video camera 2D3 for catching real time images, a transmitter 2D4 for transmitting radio waves, a sensor 2D5 for sensing the presence of any unwelcome intruders, a loudspeaker 2D6, a warning device 2D7 for issuing audio and video alerts to security person(s), an identification device 2D8 for identifying the validity of a person being present, a projector 2D9 for projecting exit routes, etc., an adjustment device 2D10 for adjusting angles of the light 2D2, the video camera 2D3 and the projector 2D9, and a power supply module 2D11 for supplying power to other components. All of the above components are electrically connected together. The sensor 2D5 may be implemented as a thermometer, a pressure sensor, a brightness sensor, a smoke detector, or a carbon dioxide detector. The identification device 2D8 may be implemented by the RFID (radio-frequency identification) technology.

The power supply module 2D11 comprises an AC power supply 2D11M1 electrically connected to an external AC power source, a power supply for light 2D11 M2, a rechargeable battery 2D11 M3, and a solar panel 2D11 M4. The switching among AC power, battery, and solar power can be done by a simple switching operation so as to be adapted to different power environments. The data communication device 2D1 comprises a power line communication module 2D1M1 for communicating data via power lines, and a wireless communication module 2D1M2 for wirelessly communicating data.

The fixed controller 3 comprises a data communicating device 3D1 including a power line communication module 3D1M1 for communicating data via power lines, a network communication module 3D1M2 for communicating data over the network, and a wireless communication module 3D1M3; and a data storage device 3D2. The fixed controller 3 further comprises a data storage module 3S1, a broadcasting module 3S2, a two-way radio transceiver 3S3, an access management module 3S4, a monitoring module 3S5 for detecting the presence of any unwelcome intruders, a detection module 3S6 for detecting any unusual activities, an illumination management module 3D7 for light management, and a projection module 3S8 for projecting security messages.

The portable controller 4 comprises a wireless communication module 4D and an equipment set module 4S.

An authorized person (e.g., home owner) may use the fixed controller 3 to activate the monitoring assemblies 2 in situ (e.g., home). Alternatively, the person may use the portable controller 4 to remotely activate the monitoring assemblies 2 when the person is not in situ. Still alternatively, the person may use the wireless device 5 (e.g., a mobile phone, a personal computer connected to the Internet by wire, or a laptop computer connected t the Internet wirelessly) to operate the fixed controller 3 in order to activate the monitoring assemblies 2 over the Internet when the person is not in situ and the Internet service is available.

While the invention has been described in terms of preferred embodiments, those skilled in the art will recognize that the invention can be practiced with modifications within the spirit and scope of the appended claims.

What is claimed is:

1. A home security system comprising:

a plurality of monitoring assemblies each comprising a data communication device, a light, a video camera, a transmitter, a sensor, a loudspeaker, a warning device, an identification device, a projector, an adjustment device that adjusts angles of the light, the video camera, and the projector, and a power supply;

a fixed controller comprising a data communicating device and a data storage device; and a hand-held portable controller comprising a wireless communication module and an equipment set module;

wherein the fixed controller is adapted to activate the monitoring assemblies; and wherein the hand-held, portable controller is adapted to remotely activate the monitoring assemblies.

2. The home security system of claim 1, wherein the data communication device comprises a power line communication module and a wireless communication module.

3. The home security system of claim 1, wherein the data communicating device comprises a power line communication module, a network communication module, and a wireless communication module.

4. The home security system of claim 1, wherein the fixed controller further comprises a data storage module, a broadcasting module, a two-way radio transceiver, an access management module, a monitoring module for detecting the presence of any unwelcome intruders, a detection module for detecting any activity of interest, an illumination management module, and a projection module.

5. The home security system of claim 1, further comprising a wireless device adapted to operate the fixed controller for activating the monitoring assemblies over the Internet.

* * * * *